US008171834B2

(12) United States Patent
Rathert

(10) Patent No.: US 8,171,834 B2
(45) Date of Patent: May 8, 2012

(54) THREE-SIDE TRIMMER, ESPECIALLY FOR SHORT RUNS

(75) Inventor: Horst Rathert, Minden (DE)

(73) Assignee: Mueller Martini Holding AG, Hergiswil (CH)

( * ) Notice: Subject to any disclaimer, the term of this patent is extended or adjusted under 35 U.S.C. 154(b) by 58 days.

(21) Appl. No.: 12/399,707

(22) Filed: Mar. 6, 2009

(65) Prior Publication Data

US 2009/0165616 A1 Jul. 2, 2009

Related U.S. Application Data

(63) Continuation-in-part of application No. 10/051,577, filed on Jan. 16, 2002, now Pat. No. 7,533,596.

(30) Foreign Application Priority Data

Jan. 17, 2001 (DE) ..... 101 01 843

(51) Int. Cl.
*B26D 1/06* (2006.01)

(52) U.S. Cl. ..... 83/404.1; 83/465; 83/934

(58) Field of Classification Search ..... 83/934, 83/465, 458, 213, 404.1, 433; 269/217, 215, 269/278, 279; 412/10, 22, 23; 100/211
See application file for complete search history.

(56) References Cited

U.S. PATENT DOCUMENTS

| | | | | |
|---|---|---|---|---|
| 1,404,239 | A | 1/1922 | Seybold | |
| 1,612,956 | A | 1/1927 | Valliquette | |
| 3,064,512 | A | 11/1962 | Zurlo | |
| 3,122,041 | A | 2/1964 | Kile | |
| 3,722,336 | A | 3/1973 | Sarring | |
| 3,733,947 | A | 5/1973 | Bryson et al. | |
| 4,615,249 | A | 10/1986 | Geiser | |
| 4,711,439 | A | 12/1987 | Campbell | |
| 4,860,620 | A | 8/1989 | Pizzorno | |
| 5,279,196 | A | 1/1994 | Mohr | |
| 6,021,698 | A * | 2/2000 | Otto et al. | 83/23 |
| 2002/0148339 | A1 | 10/2002 | Zechini | |
| 2004/0187660 | A1 | 9/2004 | Kurtz | |

FOREIGN PATENT DOCUMENTS

| | | |
|---|---|---|
| DE | 24 30 043 | 1/1975 |
| FR | 1 228 264 | 8/1960 |
| GB | 2 113 597 | 8/1983 |

* cited by examiner

*Primary Examiner* — Kenneth E. Peterson
(74) *Attorney, Agent, or Firm* — Venable LLP; Robert Kinberg; Ryan M. Flandro

(57) ABSTRACT

A trimmer including a common support frame and first and second cutting units movably mounted on the common support frame. Each respective cutting unit including a unit frame, a cutting strip connected to each respective unit frame, and a knife movably mounted on each respective unit frame for an oblique swing cut against a respective cutting strip. Each respective unit frame absorbing all cutting forces between the knife and the cutting strip during the oblique swing cut.

18 Claims, 5 Drawing Sheets

THREE-SIDE TRIMMER, ESPECIALLY FOR SHORT RUNS

CROSS-REFERENCE TO RELATED APPLICATION

This application is a continuation-in-part of U.S. application Ser. No. 10/051,577 entitled "Three-Side Trimmer, Especially for Short Runs," filed Jan. 16, 2002, now U.S. Pat. No. 7,533,596, which claims the priority of German Application No. 101 01 843.6 filed Jan. 17, 2001, both of which are incorporated herein by reference in their entirety.

FIELD OF THE INVENTION

The invention relates to three-side trimming, which is an essential process step in producing blocks for hardback books and in producing brochures.

BACKGROUND OF THE INVENTION

The three-side trimming is usually carried out in a station by the block pressed between a cutting table and a pressing plate being trimmed first at the head and the foot and then on the front. The sequence may also be reversed. The knives cut by a pinching cut against a plastic strip. The knife penetrates minimally the cutting strip during the cutting. To reduce the cutting forces at the beginning of the cutting and the cutting forces in general, the movement of the knives generates an oblique swing cut, and the movement component on the side along the knife edge is approximately equal to the normal cutting movement. At the beginning of the cutting of the block, the knife edge is at first not parallel to the cutting table, as a result of which the cut begins at a corner of the block and the cutting force increases from a low value to the maximum.

Three-side trimmers, also called trimmers, are also used in which the head and foot cut and the front cut are performed in separate stations. This type is used mainly in the case of large numbers of cutting cycles but small product thickness. The division into two stations makes possible the high cut counts.

The cutting is usually performed according to the shears principle by a knife against a counterknife. The blocks are held only by pressing strips directly next to the cutting plane for fixation during cutting.

The three-side trimmers of the type mentioned first, which cut in one station, make possible cutting of high quality in case of a solid, heavy design of the components. However, the drawback is, besides the heavy design of the components, that the pressing plate and the cutting table must be accurately coordinated format parts. The cutting table is a replaceable part with very small format jumps. The pressing plate must be accurately adapted to the finished, cut format for each product. Moreover, roundings and bevels also frequently have to be arranged in the production of brochures to prevent creases in the back and of print marks on the pressing plate from being formed. This is especially uneconomical, particularly for short runs, where the set-up time plays an especially great role.

The usual, commercially available two-station three-side trimmers are not suitable for the production of products of high quality.

Aside from the limitation of the cutting thickness, the pressing strips produce marks, especially on the back in brochures. Because of the absence of full-area pressing, there are deviations in cut. These trimmers advantageously have no format parts.

SUMMARY

The present invention combines the advantages of the two systems and eliminates drawbacks by special features.

The three-side trimming is carried out according to the present invention in two stations in order to eliminate the problem of replaceable parts for short runs. The head-and-foot cut and the front cut are performed in units of nearly identical design, and the cutting units for the head and foot in the first cutting station are adjustable in relation to one another according to the height of the format.

The knives cut by the usual oblique swing cut against cutting strips, which are replaceably fastened on stable table strips. As a result, great product thicknesses can be cut with a high quality of cut.

The pressing is performed by pressing strips directly next to the cut against the table strips.

To avoid deviations in cut, both the pressing strips of the block head cutting unit and the block foot cutting unit and the table strips of the head and foot are connected to one another by telescoping adapters, so that the block of material is held down over the full area during cutting.

Due to a slightly oblique position and elasticity, the upper adapters ensure that the air is pressed out of the block of material from the back during pressing.

A full-area cutting table is present in the second cutting station, and the pressing strip is expanded by a holding-down clamp, which also presses the air away from the back due to an oblique position and an elastic surface.

All quality requirements are thus satisfied without the use of replaceable parts. Short set-up times are associated with high quality of cutting.

The cutting units are designed as elements that are closed in themselves. All pressing and cutting forces remain within the compact units.

The knives are guided with precision over a large surface. Deformations due to the cutting forces are prevented from occurring and optimal quality of cut is in turn achieved as a result. In addition, knife breakage is prevented from occurring.

The support frame for the cutting units can have a relatively lightweight design, which leads to a considerable weight reduction compared with a commercially available three-side trimmer.

To optimize handling during the knife change, the block front cutting unit can be displaced in order to have good access to the front knife.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The present invention will be more readily understood from the following detailed description when read in conjunction with the accompanying drawings, in which.

DETAILED DESCRIPTION

Figure 1:
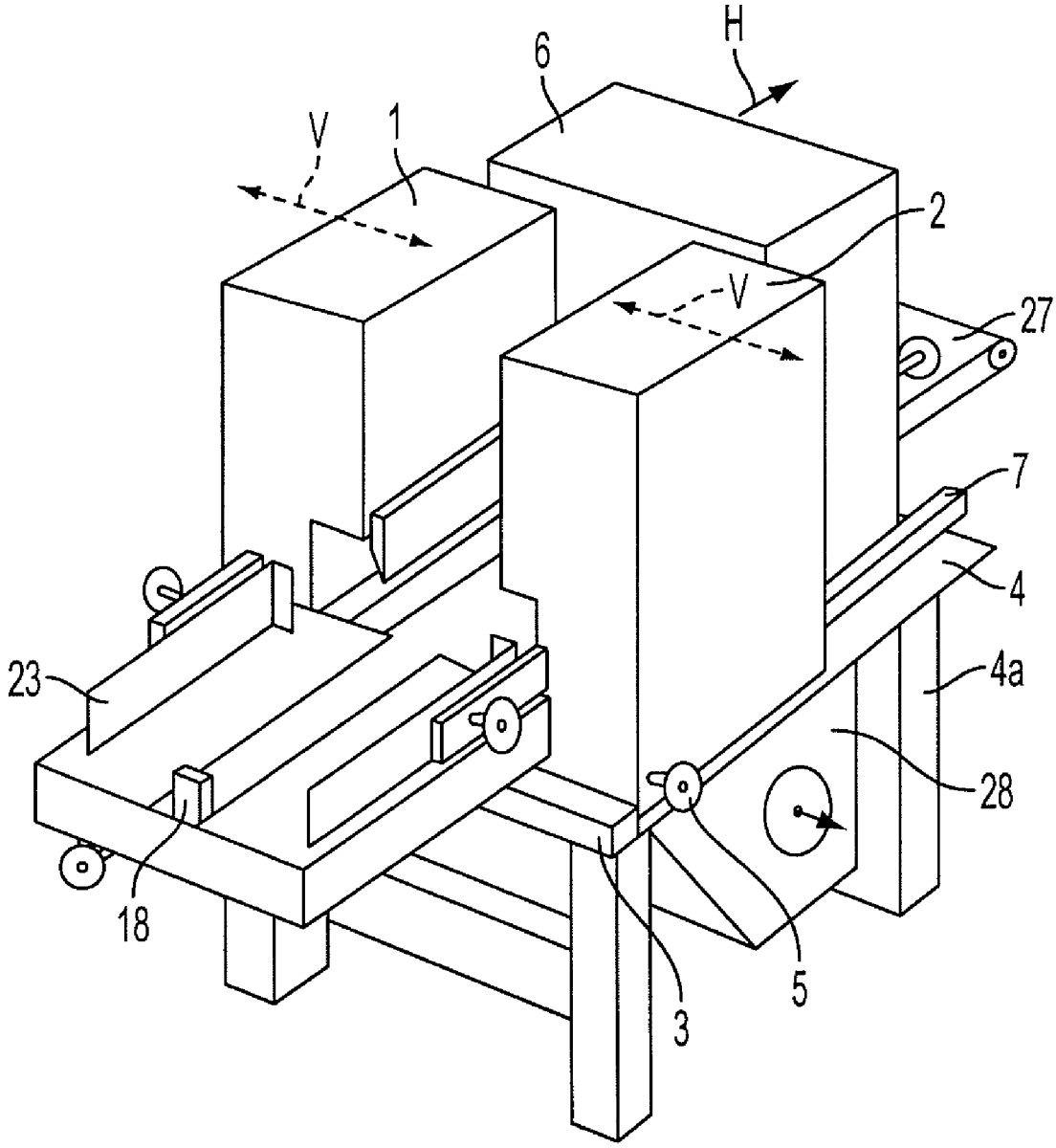
FIG. 1 is an overall perspective view of the three-side trimmer.

Referring to the drawings in particular, the cutting units for head 1 and foot 2 can be adjusted to format by the stroke v in the guides 3 on the support frame 4 with the feet 4*a*. An adjusting spindle 5 is used for this purpose. The cutting unit for front 6 can be displaced by the stroke h in the rails 7 on the support frame 4 to provide access to the front knife during the knife change. The cutting units 1, 2 and 6 are of identical design. The knife holders 9 with the knives 10 are guided in a unit frame 8. The movement takes place by means of the coupling rods 11 and the cranks 12. The obliquely extending swing cutting movement is generated by the guide roller 13, which is guided in an oblique groove in the knife holder 9. The knives cut against the cutting strips 14.

The cutting strips 14 are held in the head and foot cutting units 1, 2 by the strips 15, which are fastened directly to the frame 8. The cutting strips 14 are arranged in the second cutting station at a full-format cutting table 16, which is likewise fastened directly to the frame 8.

Figure 3:
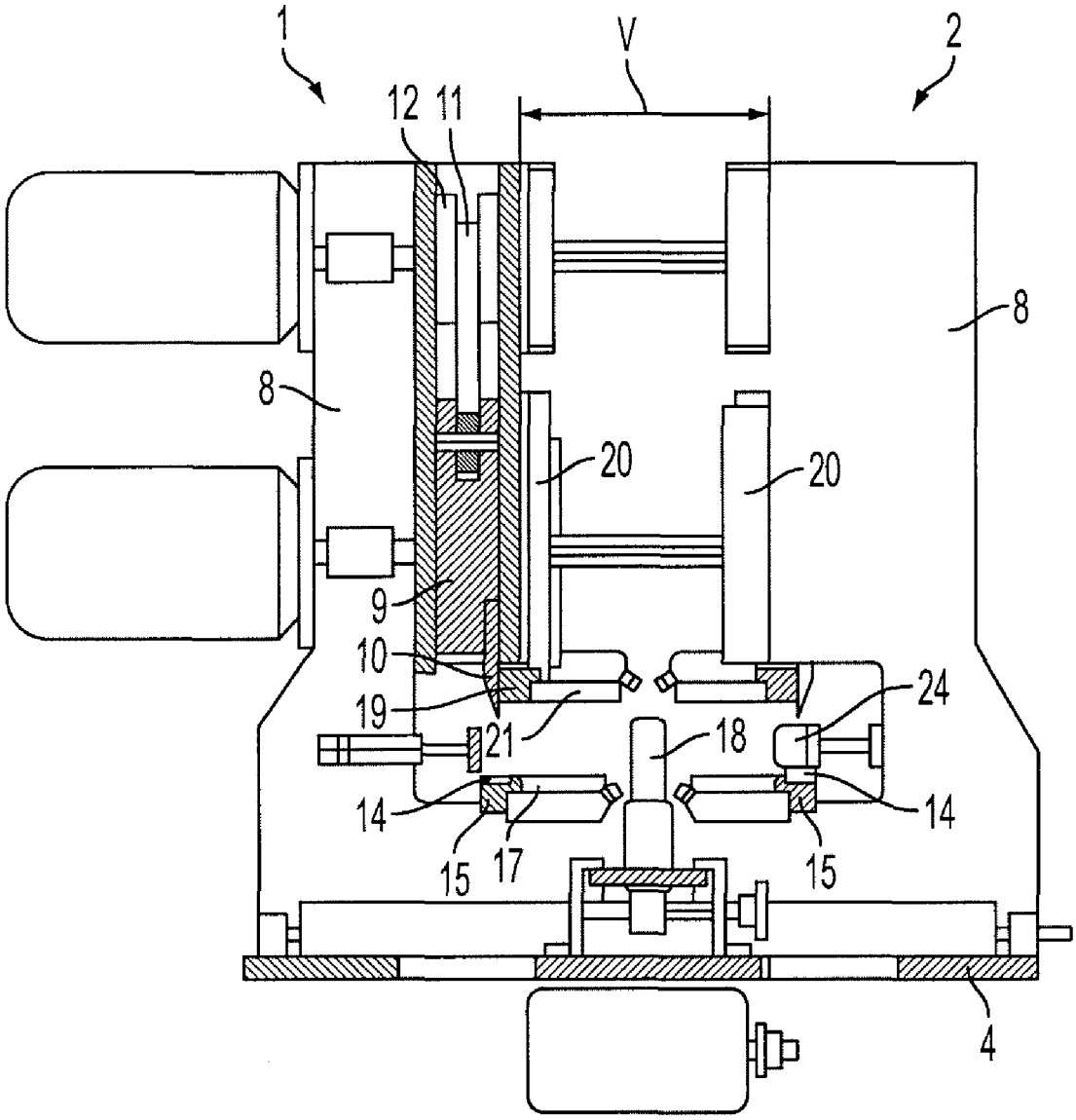
FIG. 3 is the view, in partial section, of the first cutting station in the block conveying direction.

In the first cutting station, the strips 15 are extended by telescoping adapters 17 to the passage area of the conveyor 18 in order to achieve a flat contact of the material to be cut, avoiding the use of format parts. FIG. 3 shows a possible shutter-like design of the adapters 17. Another possibility is the design similar to an accordion.

Figure 4:
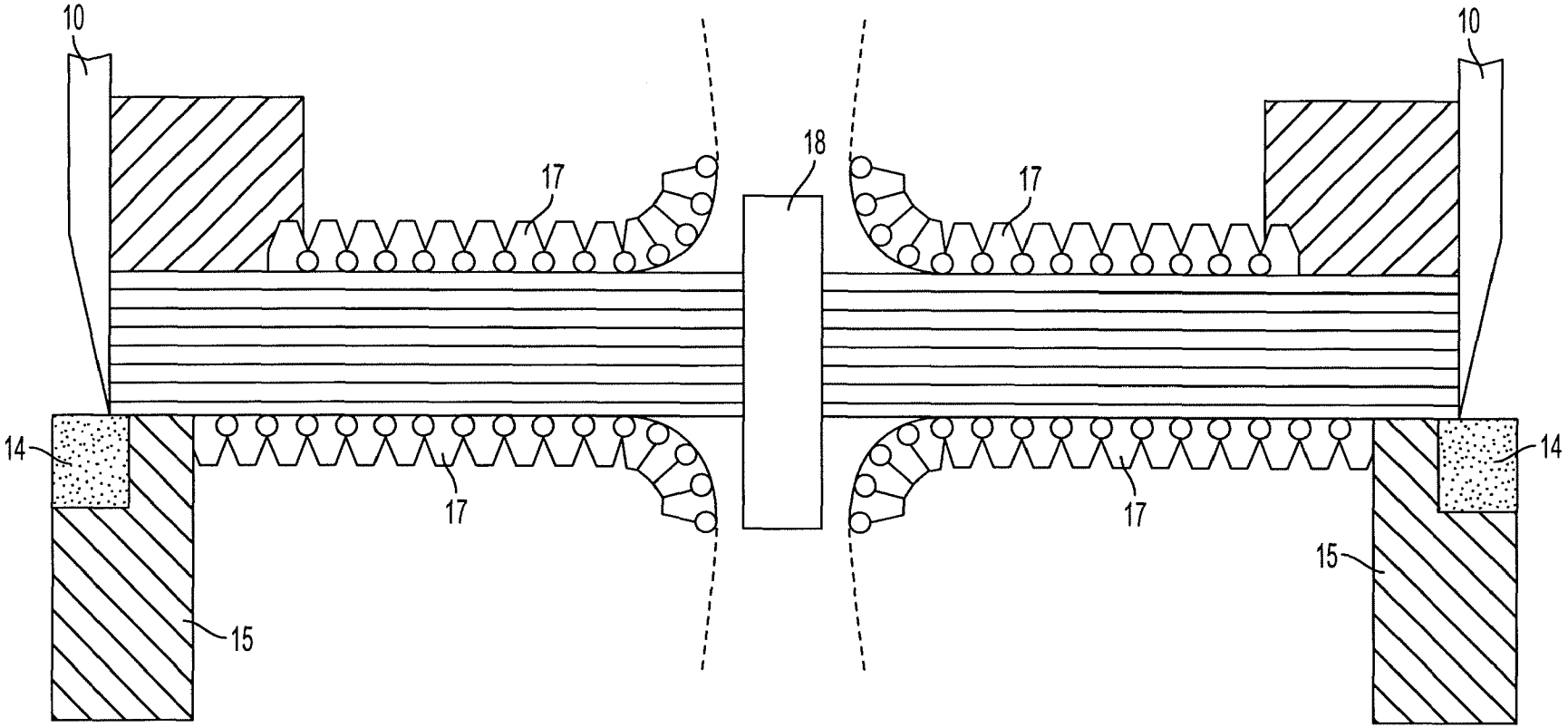
FIG. 4 is a partial cross sectional view of the adapters in an accordion-like design.
Figure 5:
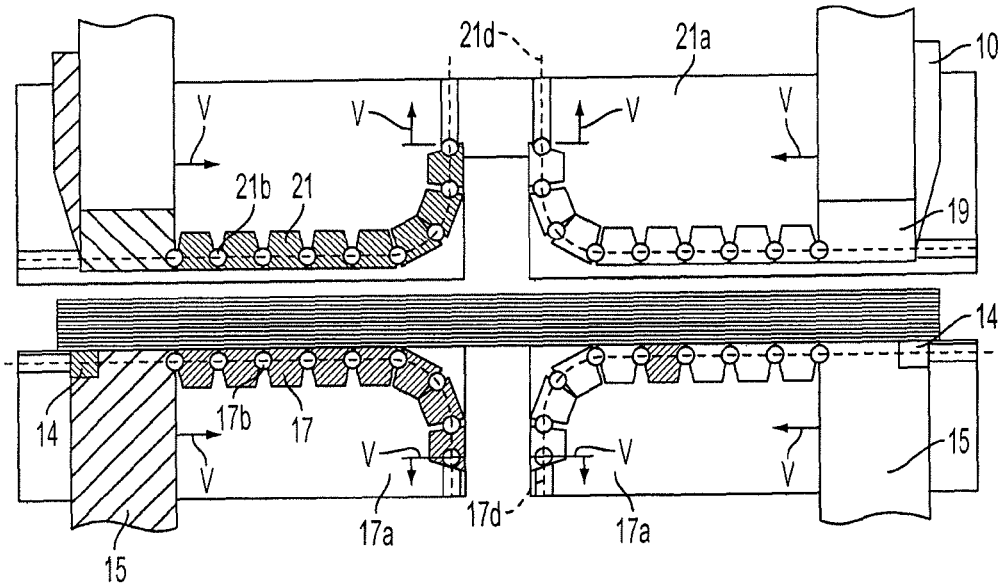
FIG. 5 is detailed cross sectional view of the accordion-like design of the adaptors.
Figure 6:
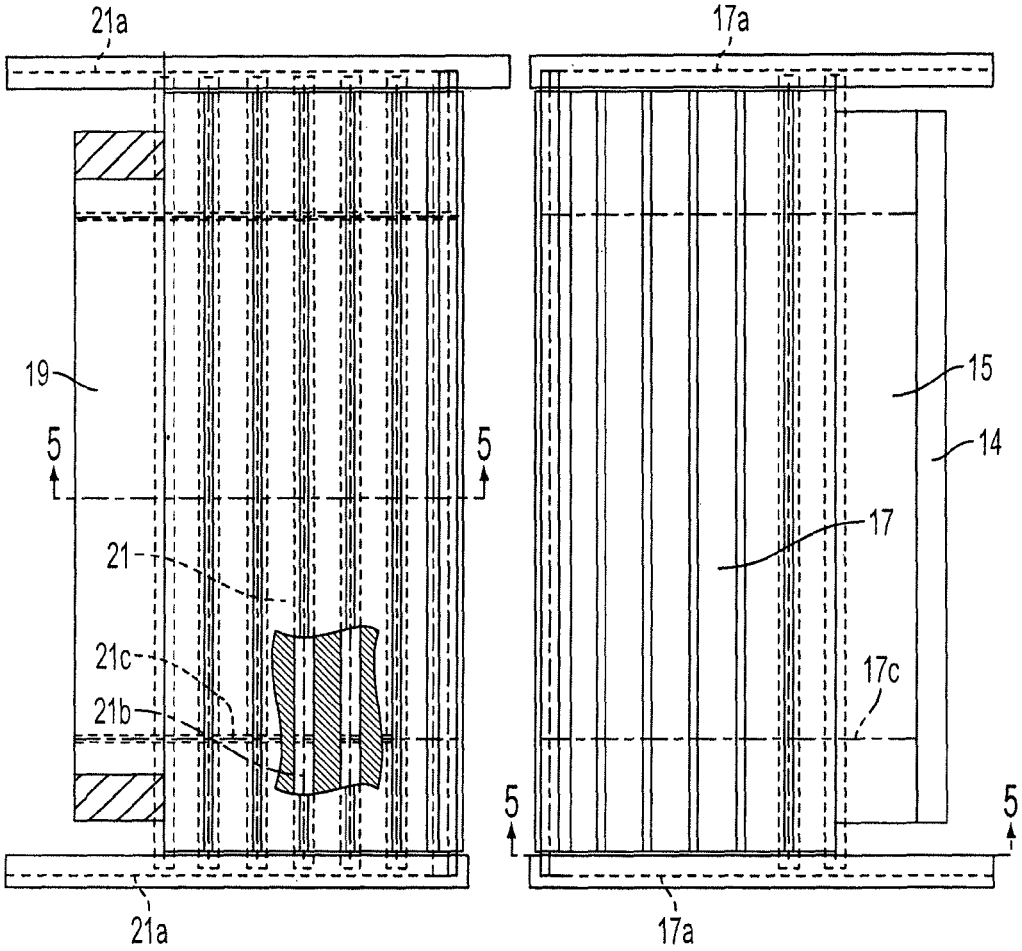
FIG. 6 is a top view of the accordion-like design of the adaptors of FIG. 5.

FIGS. 4-6 show one of the preferred accordion-like telescoping adapters. The telescoping adapters 21, 17 have bodies of a corresponding length and which are articulated to one another via the bars 21*b*, 17*b* in the attached sketches. Wire cables 21*c*, 17*c* hold all the respective parts together and under tension. The bars 21*b* and 17*b* are displaceable in the guides 21*a* and 17*a* in grooves 21*d*, 17*d*. As one can see, the cutting units with the knife 10, the cutting strip 14 and the pressing strip 19 are displaceable during adjustments in the direction V. The guides 21*a*, 17*a* remain stationary and the bars 21*b*, 17*b* of the telescoping adapters 21, 17 are displaced within the grooves 21*d*, 17*d*. This is but one design of an accordion or louver-like design of the cutting strips and pressing strips, other designs are conceivable as well.

With regard to the shutter-like design, it is possible for the pressing strips and cutting strips to have a plurality of plates which slide over each other. When the pressing strips and cutting strips are to be at their smallest size, the strips are stacked directly on top of each other. When the strips are to form a large surface area, the strips are spread out so that they are substantially in the same plane with a minimal, or no overlapping of the strips.

During cutting, the material being cut in the first cutting station is pressed by the pressing strips or elements 19, which are moved by means of toothed rack drives 20. The pressing strips are extended to the center of the machine by telescopic adapters 21. The pressing strips may be, e.g., in the form of a shutter. The pressing strips are arranged slightly obliquely, so that they touch the block first on the back in order to press out the air for the cutting, after which they easily conform elastically to the shape. For example, the elements of the shutter are coated with a foam for this purpose.

In the second cutting station, the pressing is performed by the plate 22, which in turn is moved by the toothed rack drive 20. Near the knife, in the pressing area proper, the plate 22 has a fixed support 22*a* and behind it an elastic support 22*b*, which is designed such that the back of the block comes into contact with it first.

The three cutting units have separate drives for moving the respective knives and pressing. The material to be cut is conveyed by the conveyors 18 and 18*a* moving to and fro as well as up and down by the strokes h1 and h2. During conveying into the first cutting station, the back of the block always reaches the same position regardless of the format. The pressing strips 19 have recesses in this area in order to prevent creases from being formed on the back during the trimming of brochures. In the intake, the blocks are aligned in advance by the conveyor 18 and the stop plates 23 and are aligned once again in the first cutting position by the stops 24. During the conveying by the conveyor 18*a* into the second cutting station, the block is brought over the bridge 25 up to and against the back stop 26. After the cutting has been performed, the block is then brought onto a discharge belt 27 in a manner that is not shown, e.g., by a chain conveyor running around the cutting table 16.

The trimmings drop into an exhaust channel 28. It is also possible to draw off the wastes of the two cutting stations separately because of the glue present in the first cutting station.

Each cutting unit has a knife 10 which cuts against cutting strips 14. The knives 10 and cutting strips 14 are moved toward and away from each other by coupling rods 11 and cranks 12. The knives 10 and the cutting strips 14, and their associate hardware, are all connected to each other through the unit frame 8. Each cutting unit has its own frame B. The cutting units are designed as devices that are closed in on themselves so that all pressing and cutting forces remain within the compact units. As one can see from present FIG. 3, the cutting forces generated by knife 10 against a cutting strip 14 all remain within the unit. It is well known in the art that cutting a stack of paper between a knife and a cutting strip requires that force be applied to the knife in the direction toward the cutting strip. It is also known in the general knowledge of physics that each force generates an equal and opposite force. By the cutting strip 14 and the knife 10 being connected to each other by the unit frame 8, the opposite force generated during the cutting is absorbed, or is contained by the unit frame 8. Since the unit frame is part of the cutting units, the unit frame 8 also moves with the cutting units.

Figure 2:
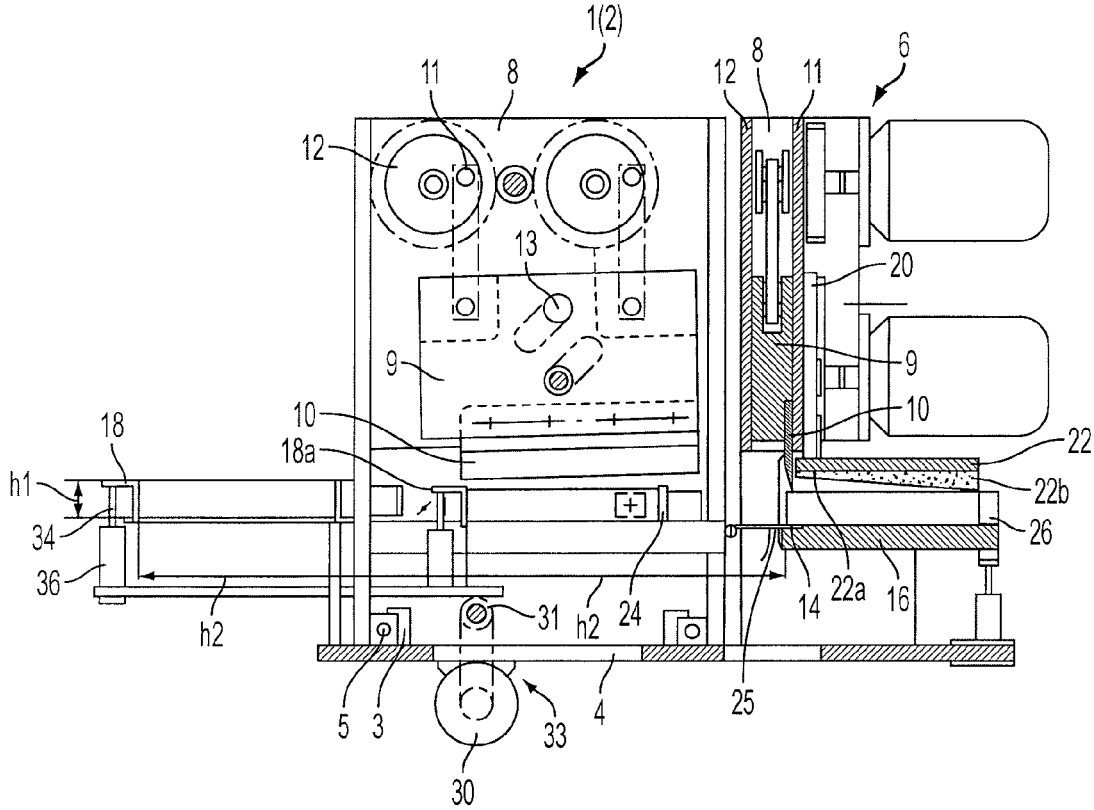
FIG. 2 is a longitudinal sectional view.

In FIG. 2 the conveyor is represented by reference 18 and 18A. In particular the top portion of conveyor 18 pushes the stack of paper into the cutting units. In the embodiment of FIG. 2, the conveyor 18 has an L-shape with the bottom of the L being driven by a drive unit 33 mounted vertically. The drive unit 33 preferably has the motor 30 on the bottom, and a drive wheel 31 on the top.

A part of the conveyor can move up and down to adjust for the height of the stack, as shown in FIG. 2. In particular, FIG. 2 shows the height of the part of the conveyor to be h1, which matches the height of the stack. If the stack height changes, the height of the conveyor also changes accordingly. While there are many ways to change the height of the conveyor, FIG. 2 shows two shafts, where the upper shaft 34 is smaller than the lower shaft 36, and can slide in and out of the lower shaft 36 to adjust the height.

It will be understood that the above description of the present invention is susceptible to various modifications, changes and adaptations, and the same are intended to be comprehended within the meaning and range of equivalents of the appended claims.

What is claimed is:

1. A three-side trimmer for cutting a block of material, comprising:

a common support frame;

a first cutting station, the first cutting station including a block head cutting unit and a block foot cutting unit;

a second cutting station, the second cutting station including a block front cutting unit, wherein each of the block head cutting unit, the block foot cutting unit, and the block front cutting unit includes a respective unit frame arranged on the common support frame, and each unit frame includes:

a cutting strip, a knife for making an oblique swing cut against the cutting strip to cut a respective edge of the block of material, a pressing strip to press the block of material during the swing cut, and a pressing drive to operate the pressing strip, wherein the block head pressing drive, the block foot pressing drive, and the block front pressing drive are all separate from each other;

wherein at least the unit frames of the block head cutting unit and block foot cutting unit each include first and second adjustable adapters coupled to the cutting strip and to the pressing strip, respectively; and wherein the block head cutting unit and the block foot cutting unit are adjustable toward and away from each other to cut blocks of material having different heights, wherein the adapters are expandable in a direction perpendicular to a direction of movement of the knife during cutting, based on a format height of the block of material to press and hold down the block of material during cutting; and a common conveyor to convey the blocks of material being cut to the first cutting station and the second cutting station.

2. A three-side trimmer in accordance with claim 1, wherein the common support frame includes a lightweight frame, the common support frame supporting a weight of the common support frame itself and dynamic forces attributed to the common support frame itself, and wherein each respective cutting unit absorbs a flow of forces attributed to forces generated in the respective cutting unit itself.

3. A three-side trimmer in accordance with claim 1, wherein the second cutting station comprises a full-area cutting table that corresponds to a largest material format, wherein the pressing strip of the block front cutting unit includes a rigid front part approximately near the respective knife, and wherein the block front cutting unit includes a slightly obliquely positioned elastic rear part.

4. The three-side trimmer in accordance with claim 1, further comprising toothed rack drives configured to displace the adjustable adapters.

5. A three-side trimmer in accordance with claim 1, wherein the pressing strips are arranged obliquely relative to an end of the block of material being cut and conform elastically to the block of material in order to remove air present in the block of material from the end of the block of material.

6. The three-side trimmer in accordance with claim 1, wherein each adjustable adapter includes a plurality of bodies articulated to one another via a plurality of bars, wherein ends of the bars are displaceable within grooves in stationary guides.

7. The three-side trimmer in accordance with claim 6, wherein each adjustable adapter further includes tensioned wire cables connecting the plurality of bodies and bars together.

8. A three-side trimmer in accordance with claim 1, wherein the block front pressing strip includes a rigid front part approximately near the respective knife, and wherein the block front pressing strip includes a slightly obliquely positioned elastic rear part.

9. A three-side trimmer in accordance with claim 1, wherein the second cutting station is displaceable to enable access to the knife.

10. A three-side trimmer in accordance with claim 1, wherein the conveyor secures an end of the block in the same position in the first cutting station during cutting, and wherein the pressing strips include recesses filled with an elastic material in the first cutting station to prevent creases from being formed on a side of the material.

11. A three-side trimmer in accordance with claim 1, wherein the conveyor comprises a first conveyor element and a second conveyor element, wherein the first conveyor element is coupled with the second conveyor element, and the first and second conveyor elements are movable to and fro and up and down.

12. A three-side trimmer in accordance with claim 1, wherein the cutting units are movably mounted on the common support frame, each knife movably mounted on each respective unit frame for making an oblique swing cut against the respective cutting strip, each respective unit frame absorbing cutting forces between the knife and the cutting strip during the oblique swing cut.

13. A trimmer in accordance with claim 12, wherein each of the cutting units includes a table fastened to the respective unit frame, wherein each pressing strip is moveably mounted on the respective unit frame, the table and the pressing strip of each respective cutting station being arranged to press the block of material between the table and the pressing strip, each respective unit frame absorbing pressing forces between the respective pressing strips and the respective tables, each respective table and respective pressing strip being movable with the respective cutting unit on the common support frame.

14. A trimmer in accordance with claim 13, wherein said pressing strips are extendable to a center of the trimmer.

15. A three-side trimmer in accordance with claim 1, each unit frame arranged for absorbing forces between the respective knife and the cutting strip during the oblique swing cut, each respective cutting unit being movably mounted as a unit on the common support frame.

16. A three-side trimmer in accordance with claim 15, wherein each of the cutting units includes a table fastened to the respective unit frame, each pressing strip moveably mounted on the respective unit frame, the table and the pressing strip of each respective cutting unit being arranged to press the block of material between the table and the pressing strip, each respective unit frame absorbing pressing forces between the respective pressing strips and the respective tables, each respective table and respective pressing strip being movable with the respective cutting unit on the common support frame.

17. A three-side trimmer in accordance with claim 16, wherein the pressing strips are extendable to a center of the trimmer.

18. A three-side trimmer in accordance with claim 1, wherein trimmings of the first cutting station and the second cutting station are disposed of separately.

* * * * *